United States Patent [19]

Ogbu

[11] Patent Number: 4,911,429

[45] Date of Patent: Mar. 27, 1990

[54] MOTORIZED SWING

[76] Inventor: Emmanuel K. Ogbu, 2322 Knob Hill Dr., #12, Okemos, Mich. 48864

[21] Appl. No.: 381,479

[22] Filed: Jul. 18, 1989

[51] Int. Cl.[4] ..... A63G 9/16

[52] U.S. Cl. ..... 272/86; 297/273

[58] Field of Search ..... 272/85–92; 297/273–282; 5/101–109

[56] References Cited

U.S. PATENT DOCUMENTS

| | | | |
|---|---|---|---|
| 1,189,393 | 7/1916 | Shaw | 297/276 |
| 3,528,657 | 9/1970 | Krudsky | 272/85 |
| 3,806,117 | 4/1974 | Foster | 272/86 |
| 3,842,450 | 10/1974 | Pad | 272/86 X |
| 4,150,820 | 4/1974 | Bochmann | 272/86 |
| 4,491,317 | 1/1985 | Bansal | 272/86 |
| 4,807,872 | 2/1989 | Spilman et al. | 272/86 |
| 4,822,033 | 4/1989 | Kottus et al. | 272/86 |

*Primary Examiner*—Richard E. Chilcot, Jr.
*Attorney, Agent, or Firm*—Leon Gilden

[57] ABSTRACT

A motorized swing is set forth including a spaced plurality of support bases and posts with support shafts horizontally oriented between the posts and securing a child's swing in a suspended fashion therefrom. Adjacent each post and spaced from the swing along the support shaft is a motor housing including a drive motor and gear drive with a downwardly depending pivot control arm directed orthogonally therefrom. Each pivot control arm is formed of a lower "L" shaped arm and an upper linear link, wherein the "L" shaped arm is pivotally mounted relative to the linear link to effect pivoting of the "L" shaped arm relative to the link and enable a varying of the swinging effect when the spaced "L" shaped arms are asymmetrically oriented relative to one another.

7 Claims, 2 Drawing Sheets

MOTORIZED SWING

BACKGROUND OF THE INVENTION

1. Field of the Invention

The field of invention relates to motorized swings, and more particularly pertains to a new and improved motorized swing wherein the same enables a variation of the swing effect upon adjustment of spaced pivotally mounted control arms.

2. Description of the Prior Art

The prior art has heretofore provided a host of motorized swings to effect a swinging motion of an underlying suspended child's swing. Examples of the prior art include U.S. Pat. No. 4,150,820 to Bochmann providing a child's motorized swing with a battery operated drive unit which includes rotation of a small crank spaced adjacent a hanger supporting the swing. The unit may utilize battery power that is rechargeable through a conventional AC circuitry.

U.S. Pat. No. 3,146,985 to Grudoski utilizing a belt-driven drive arrangement with a resilient spring to buffer the swinging effect.

U.S. Pat. No. 4,616,827 to Quinlan utilizes a battery powered solenoid to exert a motor force on a swinging infant seat to effect a swing of the seat through an attendant linkage arrangement.

U.S. Pat. No. 4,448,410 to Kosoff utilizes a baby swing suspended from a horizontal bar by spaced hangers. A direct current motor drives the rim of a wheel, which upon rotation effects rotation of a shaft imparting a corresponding swinging motion to the seat.

U.S. Pat. No. 4,785,678 to McGugan sets forth a child's swing apparatus utilizing a gear driven arrangement to effect a smooth, rocking motion of a downwardly depending link directed from the gear mechanism.

As such, it may be appreciated that there is a continuing need for a new and improved motorized swing wherein the same addresses both the problems of ease of use and effectiveness in construction to enable variation of a swinging motion by the swing apparatus.

SUMMARY OF THE INVENTION

In view of the foregoing disadvantages inherent in the known types of motorized swings now present in the prior art, the present invention provides a motorized swing wherein the same utilizes spaced links with associated flexible tether lines wherein the links are rotatable relative to one another to enable a variation of the swing effect imparted from a child's seat swing. As such, the general purpose of the present invention, which will be described subsequently in greater detail, is to provide a new and improved motorized swing which has all the advantages of the prior art motorized swings and none of the disadvantages.

To attain this, the present invention comprises a plurality of spaced pedestals and vertical supports wherein the vertical supports secure a horizontal shaft. The horizontal shaft supports and suspends the swing medially therefrom with a drive mechanism spaced from the swing on either side thereof with a downwardly depending link actuated through a gear unit to effect a pivoting of the link relative to an associated tether directed to the seat from each link. The link is rotatable relative to its support associated with the gear drive, whereupon the effective positioning of the link relative to the gear drive unit is available to impart a varying of the swinging motion imparted to the seat.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved motorized swing which has all the advantages of the prior art motorized swings and none of the disadvantages.

It is another object of the present invention to provide a new and improved motorized swing which may be easily and efficiently manufactured and marketed.

It is a further object of the present invention to provide a new and improved motorized swing which is of a durable and reliable construction.

An even further object of the present invention is to provide a new and improved motorized swing which is susceptible of a low cost of manufacture with regard to both materials and labor, and which accordingly is then susceptible of low prices of sale to the consuming public, thereby making such motorized swing economically available to the buying public.

Still yet another object of the present invention is to provide a new and improved motorized swing which provides in the apparatuses and methods of the prior art some of the advantages thereof, while simultaneously overcoming some of the disadvantages normally associated therewith.

Still another object of the present invention is to provide a new and improved motorized swing wherein the same includes adjustable links to impart a varying of a swinging motion to an associated child's swing seat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
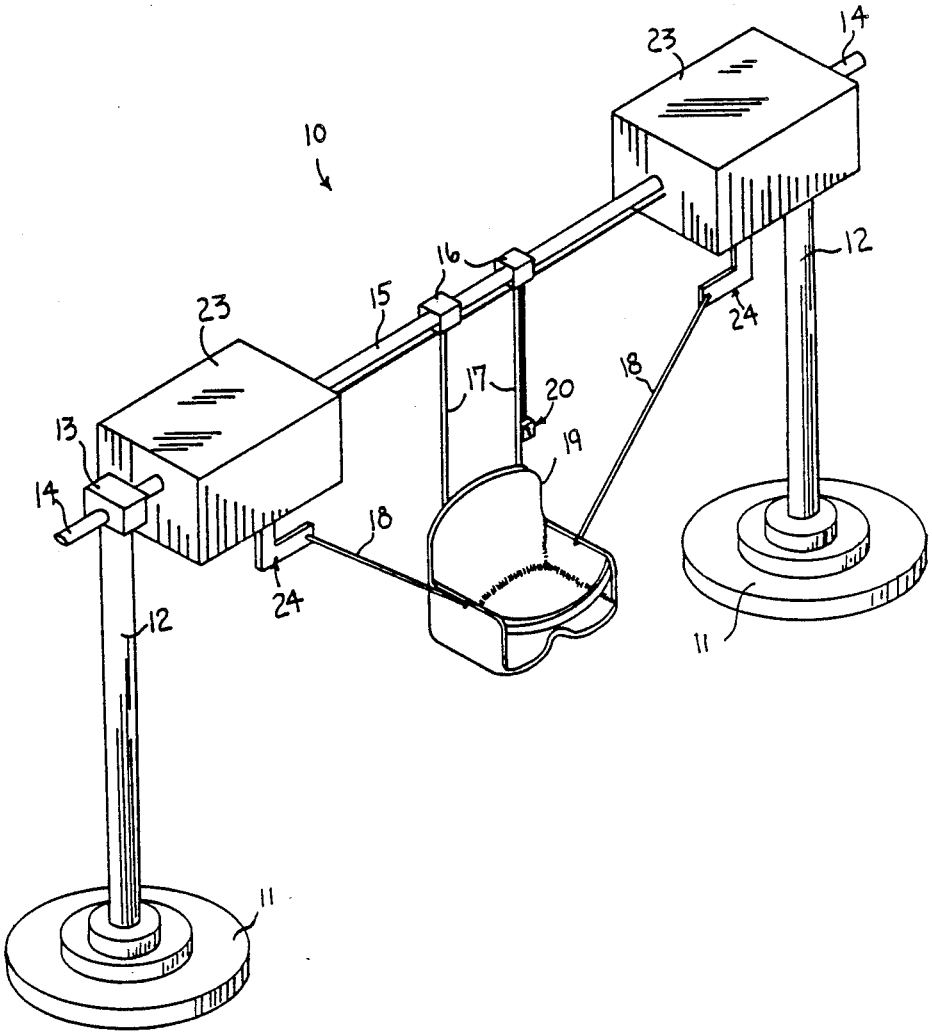
FIG. 1 is an isometric illustration of the instant invention.

With reference now to the drawings, and in particular to FIGS. 1 to 4 thereof, a new and improved motorized swing embodying the principles and concepts of the present invention and generally designated by the reference numeral 10 will be described.

Figure 3:
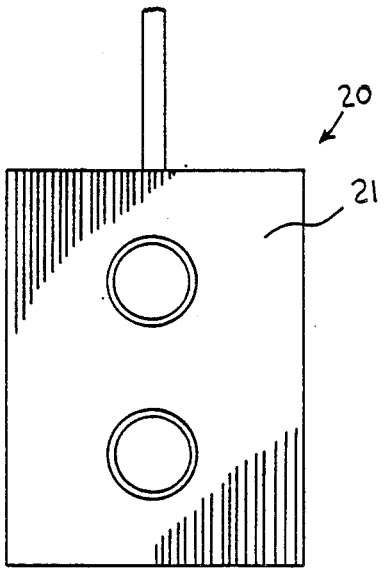
FIG. 3 is an orthographic view taken in elevation of the stop/go switch of the instant invention.
Figure 4:
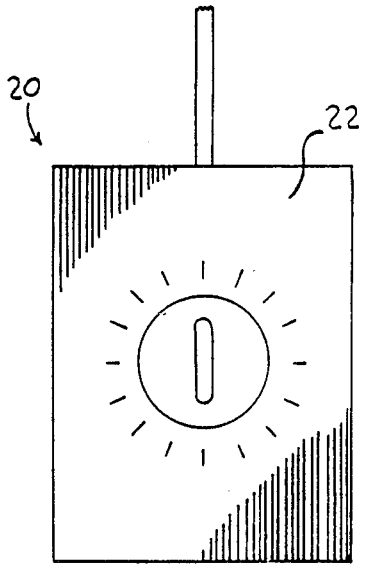
FIG. 4 is an orthographic view taken in elevation of the timer mechanism associated with the instant invention.

More specifically, the motorized swing 10 of the instant invention essentially comprises a plurality of spaced pedestal bases 11 with integrally and orthogonally secured parallel vertical posts 12 associated with each base 11. At an upper end of each post 12 is a support block 13 mounting an end support shaft 14 therein axially aligned with a central support shaft 15. Positioned and spaced medially of the central support shaft 15 are spaced-swing support anchor blocks 16 integrally receiving flexible suspension lines 17 thereto at one end of the suspension line supporting a swing seat 19 vertically therefrom. Control cables 18 are secured to each lateral side of the swing seat 19 and are received by pivotal control arms 24 that are operably mounted to respective drive housings 23 that are positioned adjacent each support block 13, as illustrated in FIG. 1. A control box 20 is mounted from an associated support rod and secured to an adjacent suspension line 17 and contains a conventional stop/go switch 21 about one forward face and a timer switch 22 about a further face, as illustrated in FIGS. 3 and 4 respectively. The switches 21 and 22 are of conventional configuration and whose operation in association with the drive mechanism is of known construction to one of ordinary skill in the art.

Figure 2:
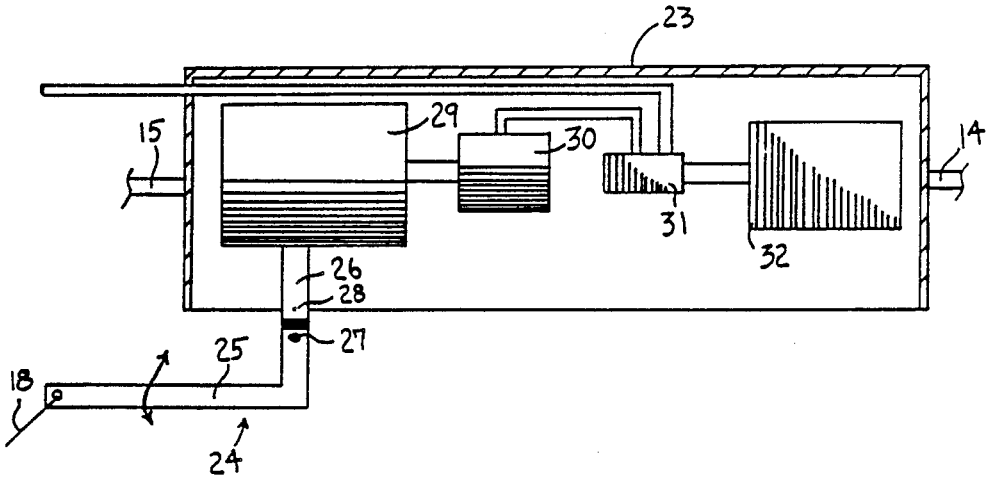
FIG. 2 is an orthographic cross-sectional view of a drive mechanism of an associated control arm of the instant invention.

Reference to FIG. 2 is illustrative of the operation of each drive housing and its associated mechanism. A lower "L" shaped arm 25 extends orthogonally downwardly from each of the drive housings 23 that includes a lower "L" shaped arm 25 pivotally mounted relative to an upper elongate linear vertical control link 26. The lower "L" shaped arm 25 includes a set screw 27 rotatable about a pivot axis within the control link 26. Relative adjustment of the "L" shaped arm 25 to the control link 26 requires that the set screw 27 be manipulated and then tightened to adjust and fit relative orientations of the "L" shaped arm 25 relative to the control link 26. The control arm 24 is mounted within a gear drive 29 of construction comparable to that as set forth in U.S. Pat. No. 4,785,678 incorporated herein by reference. A conventional electric motor 30 is operative to motivate the gear drive 29 and utilizes a junction box 31 associated with the battery pack 32 for use by itself or in combination with an AC recharge configuration as set forth in U.S. Pat. No. 4,150,820 incorporated herein by reference.

The relative rotation orientation of the "L" shaped arms 25 effects the orientation of the associated control cables 28 to effect a wobbling or swaying of the swing 19, as desired by a user of the instant invention.

As to the manner of usage and operation of the instant invention, the same should be apparent from the above disclosure, and acordingly no further discussion relative to the manner of usaage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A motorized swing to impart a swinging motion to an included swing seat comprising,
   - a plurality of spaced support bases each including upwardly extending vertical posts, and
   - a support shaft means extending for structural intercommunication with upper ends of each posts, and
   - a plurality of spaced flexible suspension lines secured to the swing at lower ends of each suspension line and to an anchor means at an upper end of each suspension line for securement of the suspension line to the support shaft, and
   - a first drive housing and a second drive housing secured to the support shaft adjacent each post, and
   - each drive housing including a drive link with a drive means to impart pivoting movement to each drive link, and
   - a cable securing each drive link to opposed lateral sides of the swing seat.

2. A motorized swing as set forth in claim 1 wherein each drive link includes a lower "L" shaped arm pivotally mounted relative to an upper elongate, linear, vertical control link, each vertical control link operably associated to the drive means.

3. A motorized swing as set forth in claim 2 wherein the lower "L" shaped arm includes a set screw and wherein the "L" shaped arm is pivotally mounted to the control link by a pivot axis orthogonally extending through the "L" shaped arm and the control link, the set screw enabling selective orientation of the "L" shaped arm relative to the control link.

4. A motorized swing as set forth in claim 3 wherein the control link is mounted within a gear drive, the gear drive forming part of the drive means.

5. A motorized swing as set forth in claim 4 wherein an electric is operably mounted to impart actuation of the gear drive and the control link.

6. A motorized swing as set forth in claim 5 further including a stop/go switch and a timer switch operably associated with a battery pack to selectively actuate the electric motor.

7. A motorized swing as set forth in claim 6 wherein each cable is oriented non-orthogonally relative to each suspension line.

* * * * *